United States Patent [19]

Wilcox et al.

[11] 4,119,880

[45] Oct. 10, 1978

[54] ELECTRONIC VALVES

[75] Inventors: David Mark Wilcox; Robert Edward Corkhill, both of Chelmsford, England

[73] Assignee: English Electric Valve Company Limited, Chelmsford, England

[21] Appl. No.: 760,992

[22] Filed: Jan. 21, 1977

[30] Foreign Application Priority Data

Jan. 29, 1976 [GB] United Kingdom ..... 3636/76

[51] Int. Cl.[2] ..... H01J 1/46; H01J 1/52; H01J 17/04; H01J 19/38

[52] U.S. Cl. ..... 313/348; 313/341; 313/343; 313/349

[58] Field of Search ..... 313/348, 341, 343, 272, 313/349, 296, 299

[56] References Cited

U.S. PATENT DOCUMENTS

| | | | |
|---|---|---|---|
| 2,656,480 | 10/1953 | Corbell et al. | 313/341 |
| 2,928,978 | 3/1960 | Morton | 313/341 X |
| 3,800,378 | 4/1974 | Lee et al. | 313/348 |
| 3,971,964 | 7/1976 | Slosiar | 313/348 |

*Primary Examiner*—Saxfield Chatmon, Jr.
*Attorney, Agent, or Firm*—Diller, Brown, Ramik & Wight

[57] ABSTRACT

An electronic valve includes a shell electrode which is mounted on a support in such a way as to provide a good continuous electrical contact therewith. The base of the shell electrode is flared and mates with a tapered portion of the support, and is held in contact therewith by means of a clamp.

14 Claims, 3 Drawing Figures

ELECTRONIC VALVES

Figure 1:
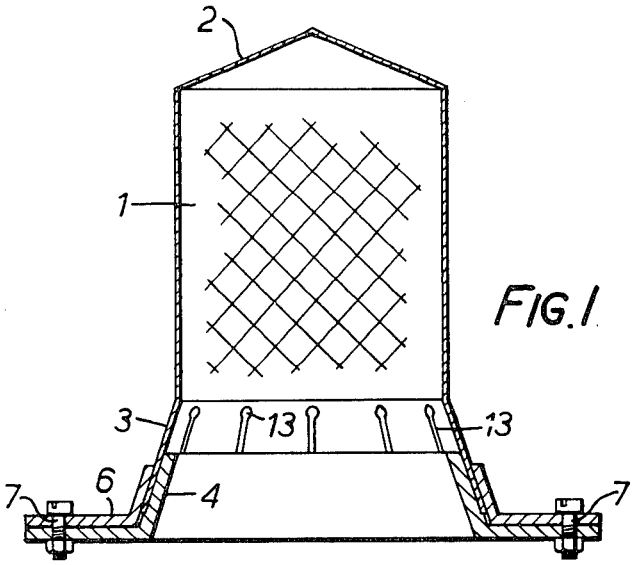

This invention relates to electronic valves and in particular electronic valves which include shell type electrodes mounted on a support assembly. Typically the shell elctrodes are in the form of cylinders of circular cross section, closed at one end. One common shell electrode is manufactured from pyrolytic graphite.

In order to mount such an electrode onto its supporting structure, it is common to use screws or bolts passing through the shell electrode itself around its base. This method of fixing the shell electrode to its support assembly suffers from a number of disadvantages in practice. Firstly, in order to make good contact around the perimeter of the base of the shell electrode, a relatively large number of screws or bolts are required. In addition, the screws or bolts are likely to be in a region of high field stress unless the shell is made much longer than is necessary in order for the high field region to be further from the ring of screws or bolts around the base of the shell.

The present invention seeks to provide an improved electronic valve including at least one shell electrode which does not suffer to the same extent from the above disadvantage.

According to this invention, an electronic valve includes at least one shell electrode wherein the base of said shell electrode is flared outwardly, a support therefor is tapered inwardly to accommodate said flare and a clamping member is provided to urge the flared base of said shell electrode onto the tapered portion of said support.

Preferably said clamping member is in the form of a flanged annulus, the inner cylindrical surface of which is tapered in accordance with the outer surface of the flared portion of said shell electrode.

Preferably the angle of taper of the former is slightly greater than the angle of taper of the latter so that contact between the former and the latter is made before clamping action is complete.

Normally clamping action is effected by means of screws or bolts provided to secure the flange of said flanged annulus to a portion of said support surrounding the tapered portion thereof.

Said last mentioned screws or bolts may form permanent parts of the assembly. If desired however, said screws or bolts may be removed after initial clamping of said shell to said tapered portion of said support member is accomplished and said clamping member and said support welded or brazed together.

Preferably the tapered surface of said support member is provided with a ledge against which the end of the flared base of said shell electrode may be abutted prior to the commencement of clamping.

The tapered portion of said support may be arranged to rise directly from the surrounding portion thereof provided to co-operate with the flanged portion of said clamping member. In one embodiment of the invention, however, the tapered portion of said support is separated from said surrounding portion provided to co-operate with the flanged portion of said clamping member, by a short cylindrical section having its axis aligned with the axis of said shell electrode.

With this last mentioned arrangement, the high field regions of the shell may be further spaced from the clamping screws and bolts than would conveniently otherwise be the case without providing a shell which was undesirably long.

Preferably said shell electrode is a pyrolytic graphite shell electrode.

Figure 2:
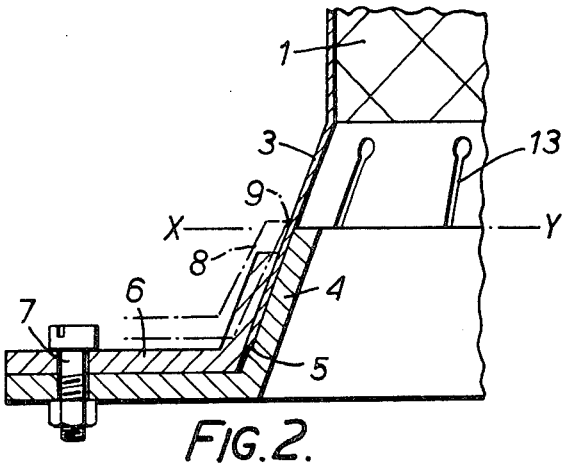
Figure 3:
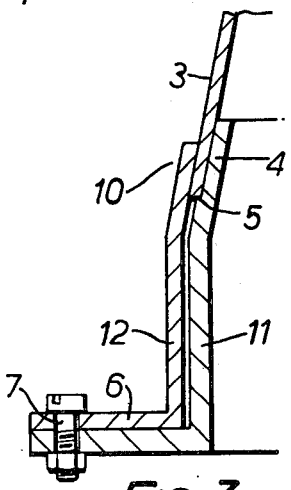

The invention is illustrated in and further described with reference to the accompanying drawing in which, FIG. 1 is a section through one shell electrode assembly in a valve in accordance with the present invention, FIG. 2 shows a larger scale the mounting of the shell electrode of FIG. 1 on its support and FIG. 3 is similar to FIG. 2, but illustrating a modification.

In all Figures like references are used for like parts.

Referring to FIGS. 1 and 2, the shell electrode 1 is a shell consisting of a cylinder of circular cross section closed at one end 2 and formed of pyrolytic graphite. The base 3 of the shell 1 is flared outwardly so as to receive the inwardly tapered portion 4 of a support. The outer surface of tapered portion 4 of the support is provided with a ledge 5 against which the end of the flared base 3 of the shell electrode 1 abuts to provide a self jigging effect. Provided to urge the flared base 3 of the shell electrode 1 onto the tapered portion 4 of the support is a clamping member 6. Clamping member 6 is in the form of a flanged annulus of which the cylindrical portion is tapered in accordance with the taper of the flared base 3 of the shell electrode. Clamping action is effected by means of a number of screws and nuts 7 which secure the flanged portion of the clamping member 6 to the portion of the support surrounding tapered portion 4. In this example tapered portion 4 rises directly out of the surrounding portion of the support.

The angle of taper of the cylindrical portion of the clamping member 6, is, in fact, slightly greater than the angle of taper of the flared base 3 of the shell electrode so that contact between the former and the latter occurs before clamping is completed. In FIG. 2 the position of the clamping member 6 prior to clamping is represented in dotted outline at 8. The point of initial contact between the clamping member 6 and the flared base 3 of the shell electrode 1 is at 9.

After clamping is completed, screws and nuts 7 may be removed if the flanged portion of clamping member 6 and the portion of the support surrounding tapered portion 4 are brazed or welded together.

In the modification illustrated in FIG. 3 the region of clamping force 10 and the flared base 3 of the pyrolytic shell 1 are further removed from the screws 7 which are responsible for the clamping force by the tapered portion 4 of the support member being mounted on a short cylindrical section 11 whose axis is aligned with the axis of said shell electrode 1. Clamping member 6 includes a corresponding cylindrical portion 12.

During manufacture the point 9 at which the clamping member 6 first contacts the flared base 3 of the shell electrode 1 is arranged to lie below the datum line X-Y, co-incident with the end face of the tapered portion 4 of the support so that the shell is supported by the tapered portion 4 of the support during clamping.

In order to reduce the problems of differential thermal expansion between the pyrolytic graphite material of the shell electrode 1 and the material of the parts forming the clamp, slits as represented at 13 in FIG. 1 are machined in the flared base 3 of the electrode 1.

We claim:

1. An electronic valve including at least one shell electrode wherein the base of said shell electrode is flared outwardly, a support therefor is tapered inwardly to accommodate said flare and a clamping member is provided to urge the flared base of said shell electrode onto the tapered portion of said support.

2. A valve as claimed in claim 1 and wherein said clamping member is in the form of a flanged annulus, the inner cylindrical surface of which is tapered in accordance with the outer surface of the flared portion of said shell electrode.

3. A valve as claimed in claim 2 and wherein the angle of taper of the former is slightly greater than the angle of taper of the latter so that contact between the former and the latter is made before clamping action is complete.

4. A valve as claimed in claim 1 and wherein clamping action is effected by means of screws or bolts provided to secure the flange of said flanged annulus to a portion of said support surrounding the tapered portion thereof.

5. A valve as claimed in claim 4 and wherein said last mentioned screws or bolts form permanent parts of the assembly.

6. A valve as claimed in claim 4 and wherein said screws or bolts are removed after initial clamping of said shell to said tapered portion of said support member is accomplished and said clamping member and said support welded or brazed together.

7. A valve as claimed in claim 1 and wherein the tapered surface of said support member is provided with a ledge against which the end of the flared base of said shell electrode may be abutted prior to the commencement of clamping.

8. A valve as claimed in claim 2 and wherein tapered portion of said support is arranged to rise directly from the surrounding portion thereof provided to co-operate with the flanged portion of said clamping member.

9. A valve as claimed in claim 2 and wherein the tapered portion of said support is separated from said surrounding portion provided to co-operate with the flanged portion of said clamping member, by a short cylindrical section having its axis aligned with the axis of said shell electrode.

10. A valve as claimed in claim 1 and wherein said shell electrode is a pyrolytic graphite shell electrode.

11. In an electronic valve, the combination of:

a support member having a substantially flat annular portion and a frusto conical tapered portion joined with the inner periphery of said annular portion;

a shell electrode of cylindrical form having an outwardly flared base dimensioned to receive and seat upon said tapered portion of the support member in face-to-face contact therewith;

a clamping member having a substantially flat annular portion and a frusto conical tapered portion joined with the inner periphery of such annular portion, said tapered portion of the clamping member being dimensioned to seat upon said outwardly flared base of the shell electrode in face-to-face contact therewith and to clamp said base between said frusto conical portions when said annular portion of the clamping member is urged into contact with said annular portion of the support member; and means for maintaining said annular portions in contact with each other whereby firmly to grip said base of the shell electrode between said frusto conical portions.

12. In an electronic valve as defined in claim 11 wherein the outer surface of said frusto conical portion of the support member is provided with a ledge defining a seat for the end edge of said base of the shell electrode.

13. In an electronic valve as defined in claim 12 wherein the angle of taper of said frusto conical portion of the clamping member initially is slightly greater than the angle of taper of said frusto conical portion of the support member.

14. In an electronic valve as defined in claim 11 wherein the angle of taper of said frusto conical portion of the clamping member initially is slightly greater than the angle of taper of said frusto conical portion of the support member.

* * * * *